US007980681B2

(12) United States Patent
Kim et al.

(10) Patent No.: US 7,980,681 B2
(45) Date of Patent: Jul. 19, 2011

(54) INK-JET HEAD AND MANUFACTURING METHOD THEREOF

(75) Inventors: Sang-Jin Kim, Seoul (KR); Jea-Woo Joung, Suwon-si (KR); Young-Seuck Yoo, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 273 days.

(21) Appl. No.: 12/285,134

(22) Filed: Sep. 29, 2008

(65) Prior Publication Data

US 2009/0251519 A1 Oct. 8, 2009

(30) Foreign Application Priority Data

Apr. 7, 2008 (KR) ..... 10-2008-0032071

(51) Int. Cl.
*B41J 2/045* (2006.01)
*B41J 2/14* (2006.01)
*B41J 2/16* (2006.01)

(52) U.S. Cl. ..... 347/70; 347/53

(58) Field of Classification Search ..... 347/53–54
See application file for complete search history.

(56) References Cited

U.S. PATENT DOCUMENTS 4,730,197 A * 3/1988 Raman et al. ..... 347/40
6,386,682 B1 * 5/2002 Kimura ..... 347/54

FOREIGN PATENT DOCUMENTS

JP 2002-187272 7/2002
JP 2006-264079 10/2006

OTHER PUBLICATIONS

Japanese Office Action for corresponding Japanese Patent Application No. 2008-260956 dated Feb. 22, 2011, 3 pages.

* cited by examiner

*Primary Examiner* — Matthew Luu
*Assistant Examiner* — Lisa M Solomon

(57) ABSTRACT

Disclosed are an ink-jet head and a manufacturing method thereof. The ink-jet head, which has a reservoir storing ink, a chamber being supplied with the ink from the reservoir, a restrictor connecting the reservoir to the chamber, and a nozzle discharging the ink, includes: a chamber plate, in which the chamber is formed; a vibration plate, which is laminated on an upper surface of the chamber plate to cover the chamber and in which a first coil is placed; a first middle plate, which is laminated on a lower surface of the chamber plate and in which the restrictor is formed, and a second coil is placed; and a lower plate part, which is laminated on a lower surface of the first middle plate and in which the reservoir and the nozzle are formed.

11 Claims, 13 Drawing Sheets

INK-JET HEAD AND MANUFACTURING METHOD THEREOF

CROSS-REFERENCE TO RELATED APPLICATIONS

This application claims the benefit of Korean Patent Application No. 10-2008-0032071, filed with the Korean Intellectual Property Office on Apr. 7, 2008, the disclosure of which is incorporated herein by reference in its entirety.

BACKGROUND

1. Technical Field

The present invention relates to an ink-jet head and a manufacturing method thereof.

2. Description of the Related Art

Ink-jet heads employ a principle of causing ink to be discharged in the form of a droplet through a small nozzle by converting an electric signal into a physical force. Ink-jet heads are usually made of Steel Use Stainless (SUS), ceramic material or silicon material.

The ink-jet head contains elements that perform various functions. Each of the elements is separately processed in several layers, which are adhered to one another to form the ink-jet head. Generally, a piezoelectric substance (PZT) is used as an actuator of the ink-jet head. The thickness of the head is adjusted by using a mechanical polishing process after joining the piezoelectric substance on a vibration plate.

Depending on the material used, the piezoelectric substance is depoled at the temperature of between 100° C. and 350° C. Accordingly, if the process of manufacturing an inkjet head includes a heating process, it is necessary to perform a separate poling process after completing the manufacture of the head, complicating the overall process and increasing the cost.

SUMMARY

The present invention provides an ink-jet head having a simple manufacturing process, a wide choice of material or reducible process cost, and a manufacturing method thereof.

An aspect of the present invention features an ink-jet head having a reservoir storing ink, a chamber being supplied with the ink from the reservoir, a restrictor connecting the reservoir to the chamber, and a nozzle discharging the ink. The ink-jet head in accordance with an embodiment of the present invention can include: a chamber plate, the chamber being formed in the chamber plate; a vibration plate, being laminated on an upper surface of the chamber plate to cover the chamber, a first coil being placed in the vibration plate; a first middle plate, the restrictor being formed in the first middle plate, the first middle plate being laminated on a lower surface of the chamber plate, a second coil being placed in the first middle plate; and a lower plate part, the reservoir and the nozzle being formed in the lower plate part, the lower plate part being laminated on a lower surface of the first middle plate.

The lower plate part can includes: a reservoir plate, the reservoir being formed in the reservoir plate, the reservoir plate being laminated on a lower surface of the first middle plate; a second middle plate being laminated on a lower surface of the reservoir plate; and a nozzle plate, the nozzle being formed in the nozzle plate, the nozzle plate being laminated on a lower surface of the second middle plate.

Meanwhile, the vibration plate, the chamber plate, the first middle plate and the lower plate part can be made of a low temperature co-fired ceramic (LTCC) material.

Also, a via passing through the vibration plate and the chamber plate can be formed such that the via is electrically connected to the second coil. The first coil and the second coil can be configured not to be exposed in the direction of the chamber.

Another aspect of the present invention features a method of manufacturing an ink-jet head having a reservoir storing ink, a chamber being supplied with the ink from the reservoir, a restrictor connecting the reservoir to the chamber, and a nozzle discharging the ink. The method in accordance with an embodiment of the present invention can include: forming a vibration plate, a first coil being placed inside the vibration plate; forming a chamber plate, the chamber being processed in the chamber plate; forming a first middle plate, the restrictor being processed in the first middle plate, a second coil being placed inside the first middle plate; forming a lower plate part, the reservoir and the nozzle being processed in the lower plate part; and laminating the vibration plate, the chamber plate, the first middle plate and the lower plate part.

The forming a vibration plate can include: patterning the first coil on an upper surface of a first green sheet; laminating a second green sheet on the upper surface of the first green sheet; and low temperature co-firing the first green sheet and the second green sheet.

Meanwhile, the forming a chamber plate can include: processing the chamber on a third green sheet; filling a support material in the chamber; sintering the third green sheet; and removing the support material.

Also, the lower plate part can include: a reservoir plate, the reservoir being formed in the reservoir plate, the reservoir plate being laminated on a lower surface of the first middle plate; a second middle plate being laminated on a lower surface of the reservoir plate; and a nozzle plate, the nozzle being formed in the nozzle plate, the nozzle plate being laminated on a lower surface of the second middle plate.

A via passing through the vibration plate and the chamber plate can be further formed such that the via is electrically connected to the second coil. The first coil and the second coil can be configured not to be exposed in the direction of the chamber.

DETAILED DESCRIPTION

Figure 1:
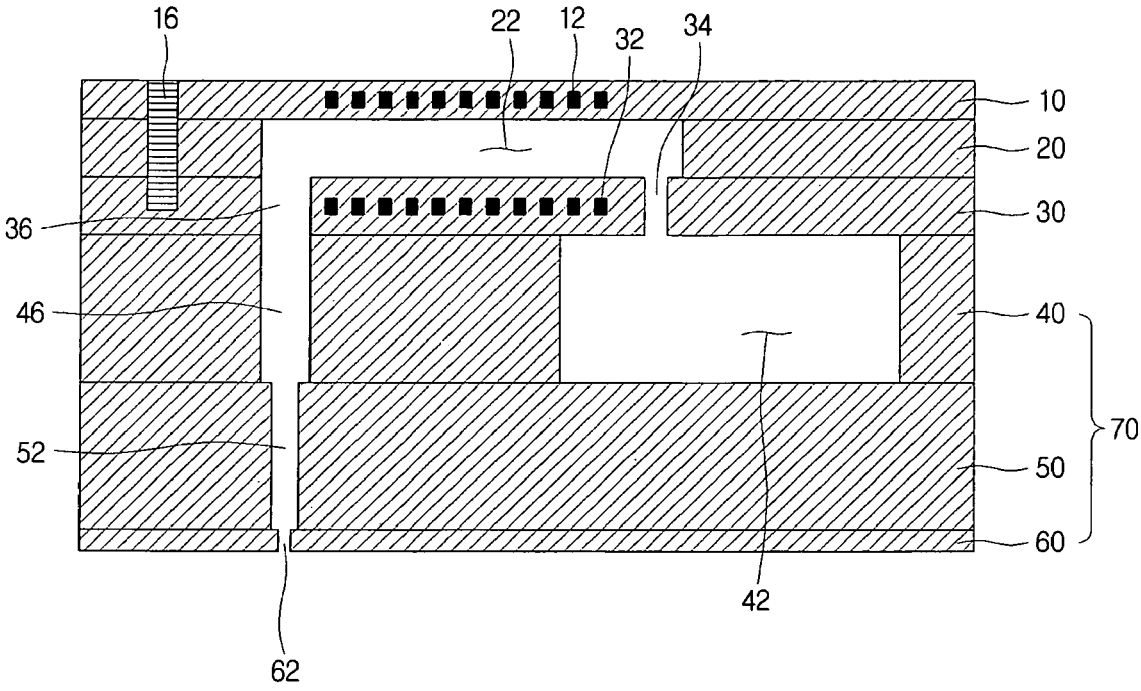
FIG. 1 illustrates a cross section of an ink-jet head according to an embodiment of the present invention.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the spirit and scope of the present invention. In the following description of the present invention, the detailed description of known technologies incorporated herein will be omitted when it may make the subject matter unclear.

Terms such as "first" and "second" can be used in describing various elements, but the above elements shall not be restricted to the above terms. The above terms are used only to distinguish one element from the other.

The terms used in the description are intended to describe certain embodiments only, and shall by no means restrict the present invention. Unless clearly used otherwise, expressions in the singular number include a plural meaning. In the present description, an expression such as "comprising" or "consisting of" is intended to designate a characteristic, a number, a step, an operation, an element, a part or combinations thereof, and shall not be construed to preclude any presence or possibility of one or more other characteristics, numbers, steps, operations, elements, parts or combinations thereof.

Hereinafter, certain embodiments of an ink-jet head and a manufacturing method thereof will be described in detail with reference to accompanying drawings. In the description with reference to accompanying drawings, the same reference numerals will be assigned to the same or corresponding elements, and repetitive descriptions thereof will be omitted.

Referring to FIG. 1, which illustrates a cross section of an ink-jet head according to an embodiment of the present invention, the ink-jet head includes a vibration plate 10, a first coil 12, a via 16, a chamber plate 20, a chamber 22, a first middle plate 30, a second coil 32, a restrictor 34, passages 36, 46, 52, a reservoir plate 40, a reservoir 42, a second middle plate 50, a nozzle plate 60 and a nozzle 62.

The reservoir 42 formed in the reservoir plate 40 holds ink and supplies the ink to the chamber 22 through the restrictor 34, which will be described later. The reservoir 42 can be supplied with ink from the outside through an inlet (not shown).

The restrictor 34 formed in the first middle plate 30 connects the reservoir 42 to the chamber 22, which will be described later, and thus can function as a channel for supplying the ink from the reservoir 42 to the chamber 22. Since the restrictor 34 is made to have a smaller cross section than the reservoir 42, the amount of ink supplied to the chamber 22 from the reservoir 42 can be also adjusted when pressure is applied to the chamber 22.

The second coil 32 is placed inside the first middle plate 30 to which the chamber 22 corresponds. The second coil 32 placed inside the first middle plate 30 functions to supply pressure to the inside of the chamber 22, along with the first coil 12, which will be described later. This operation will be later described in more detail.

The vibration plate 10 is laminated on an upper surface of the chamber plate 20 and covers the chamber 22. The first coil 12, corresponding to the second coil 32 described above, can be placed inside the vibration plate 10. The first coil 12 can function to supply pressure to the inside of the chamber 22, along with the second coil 32.

In other words, the first coil 12 and the second coil 32 can function as an electromagnet, once electric current is supplied from the outside, and it becomes possible to apply pressure to the inside of the chamber 22 through the use of repulsive force and attractive force between the two coils.

For example, if the electric current is supplied to have the first coil 12 and the second coil 32 attract each other, the vibration plate 10, in which the first coil 12 is placed, becomes bent toward the chamber 22 due to the attractive force, thereby applying pressure to the inside of the chamber 22.

To the contrary, if the electric current is supplied to have the first coil 12 and the second coil 32 repulse each other, the vibration plate 10, in which the first coil 12 is placed, becomes bent against the chamber 22 due to the repulsive force, thereby applying negative pressure to the inside of the chamber 22.

The via 16 can be formed in order to supply an electric current to the second coil 32, which is located relatively inside the ink-jet head. In other words, as illustrated in FIG. 1, the via 16 passes through the vibration plate 10 and the chamber plate 20 to be electrically connected to the second coil 32, which is formed in the first middle plate 30, so that an electric current can be supplied to the second coil 32.

As described above, the ink-jet head according to an embodiment of the present invention applies pressure to the inside of the chamber 22 by using the first coil 12 and the second coil 32, making it unnecessary to add a separate structure such as a piezoelectric substance.

Unlike ink-jet heads for office use, ink-jet heads for industrial use may use high temperature ink. In order to prevent the first coil 12 and the second coil 32 from being damaged by such high temperature ink, the first coil 12 and the second coil 32 can be formed not to be exposed in the direction of the formation of the chamber 22, as illustrated in FIG. 1. Referring to FIG. 1, the first coil 12 and the second coil 32 can be formed lest they should be exposed in the lower direction and the upper direction, respectively.

The nozzle 62 formed in the nozzle plate 60 is connected to the chamber 22 and receives the ink from the chamber 22 so that it can perform a function of discharging the ink. Once the first coil 12 and the second coil 32 apply pressure to the chamber 22, the pressure causes the ink to be discharged through the nozzle 62.

The second middle plate 50, which covers the lower surface of the reservoir 42, can be interposed between the nozzle plate 60 and the reservoir plate 40. The passages 36, 46 and 52 can be formed in the first middle plate 30, the reservoir plate 40 and the second middle plate 50, respectively, such that the chamber 22 is allowed to be connected to the nozzle 62.

While the present embodiment shows that the reservoir plate 40, the second middle plate 50 and the nozzle plate 60 are separated, it is also possible that they are integrated into one lower plate part 70.

In other words, the lower plate part 70, in which the reservoir 42 and the nozzle 62 can be formed, can have, as shown in FIG. 1, the reservoir plate 40, the second middle plate 50 and the nozzle plate 60, which can be also integrated to a single structure, although not illustrated.

Above, the structure of an ink-jet head according to an embodiment of the present invention has been described. Below, a manufacturing method of an ink-jet head according to another embodiment of the present invention will be described. The ink-jet head described above can be also manufactured through the manufacturing method to be described below.

Figure 2:
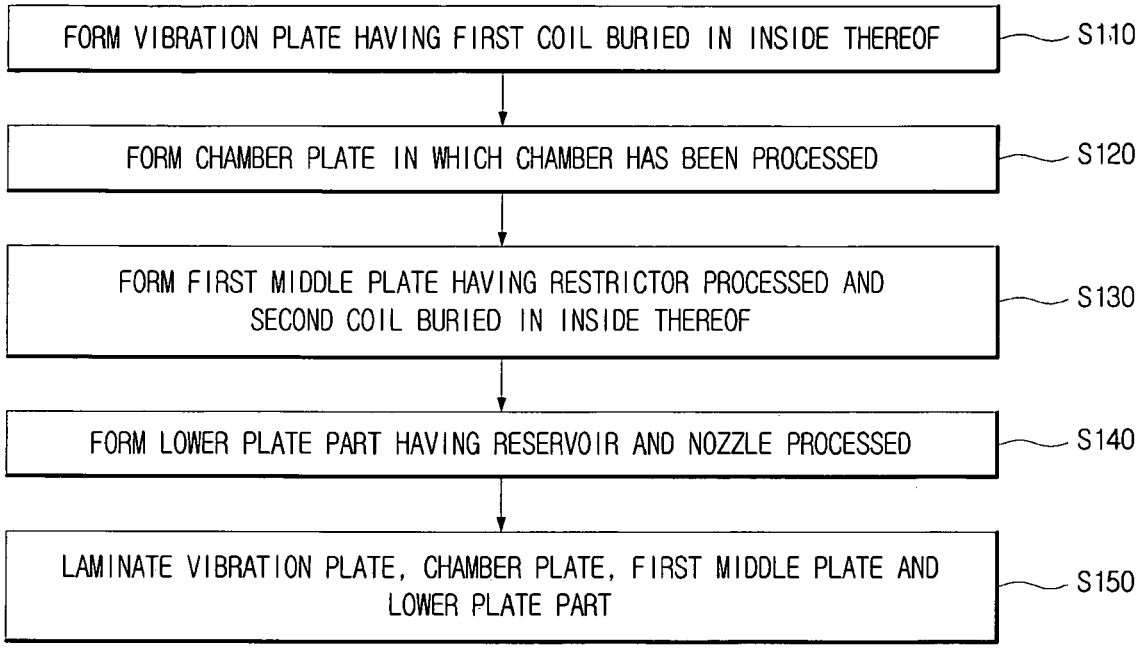
FIG. 2 illustrates a flowchart of an ink-jet head manufacturing method according to another embodiment of the present invention.

FIG. 2 is a flowchart showing an ink-jet head manufacturing method according to another embodiment of the present invention. FIGS. 3 to 13 are cross sections illustrating the process of an ink-jet head manufacturing method according to another embodiment of the present invention. Illustrated in FIGS. 3 to 13 are a vibration plate 10, a first green sheet 10*a*, a second green sheet 10*b*, a first coil 12, a via 16, a chamber plate 20, a third green sheet 20', a chamber 22, a support material 24, a first middle plate 30, a second coil 32, a restrictor 34, passages 36, 46 and 52, a reservoir plate 40, a reservoir 42, a second middle plate 50, a nozzle plate 60 and a nozzle 62.

Figure 3:
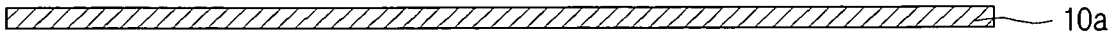
FIGS. 3 to 13 are cross sections illustrating the process of an ink-jet head manufacturing method according to another embodiment of the present invention.
Figure 4:
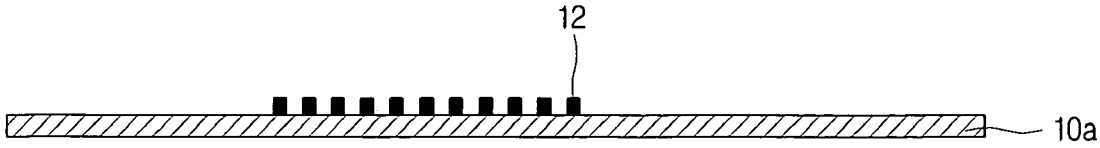
Figure 6:
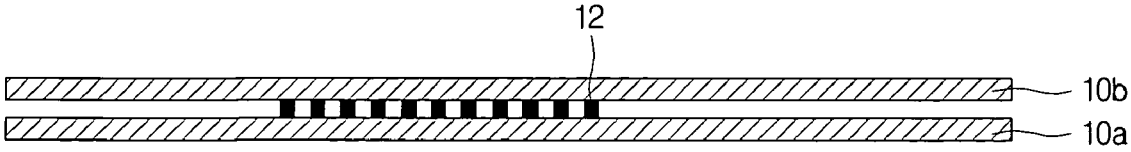
Figure 7:
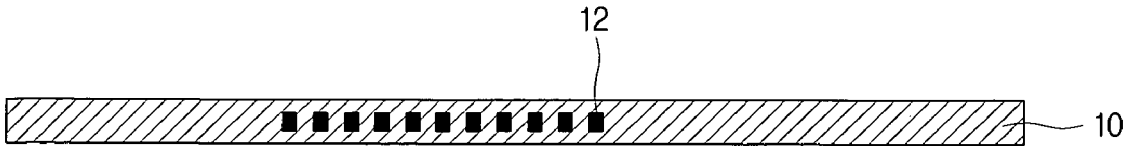

First, the vibration plate 10, in which the first coil 12 is placed, is formed in a step represented by S110. To this end, as illustrated in FIGS. 3 and 4, the first coil 12 is patterned on the upper surface of the first green sheet 10*a*, which is in a pre-sintering state, and, as illustrated in FIG. 6, the second green sheet 10*b* is laminated on the upper surface of the first green sheet 10*a*, followed by low temperature co-firing.

Figure 5:
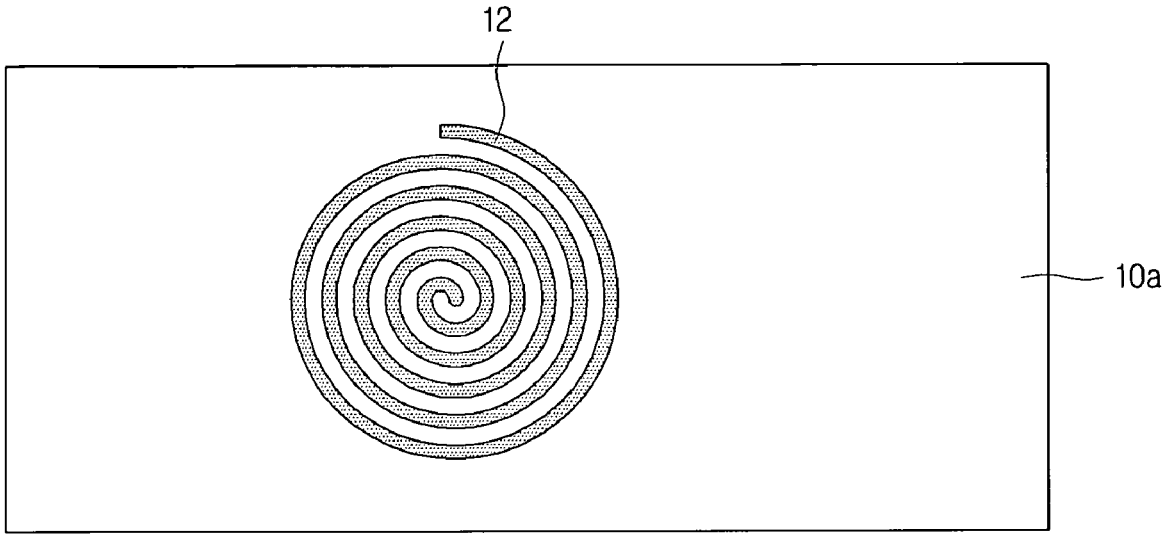

The first coil 12 can function as an electromagnet by being supplied with an electric current. FIG. 4 illustrates a cross section showing the patterned first coil 12. FIG. 5 illustrates a plan view showing the patterned first coil 12. The first coil 12 can be patterned through a screen printing method or an ink jet printing method as well as many other methods.

Figure 8:
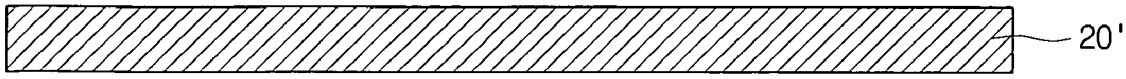
Figure 9:
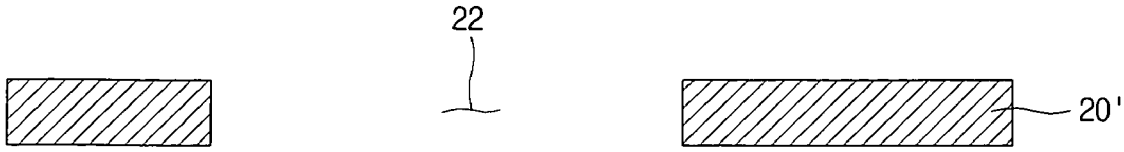

Then, the chamber plate 20, in which the chamber 22 is processed, is formed in a step represented by S120. For this purpose, the chamber 22, as illustrated in FIGS. 8 and 9, is formed by processing the third green sheet 20', which is in a pre-sintering state, and then sintered.

Figure 10:
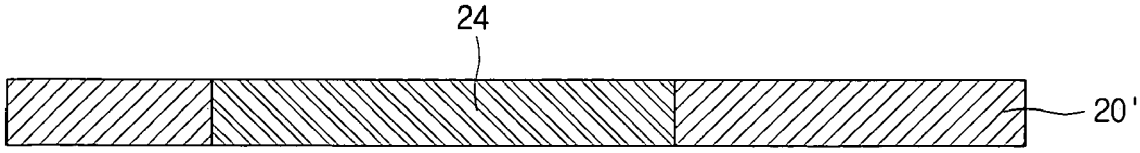
Figure 11:
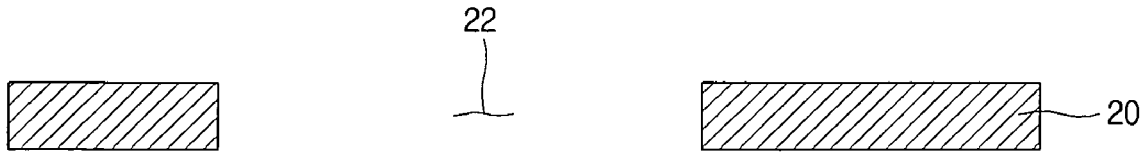

Sintering the third green sheet 20', in which the chamber 22 has been processed, may cause the third green sheet 20' to shrink during the sintering process. In order to prevent the shrinking, the support material 24 can be filled in the chamber 22 before the sintering and then removed after the sintering, as illustrated in FIG. 10. An HTCC material or metallic material can be used as the support material 24. The chamber plate 20 formed through the above method is illustrated in FIG. 11.

Figure 12:
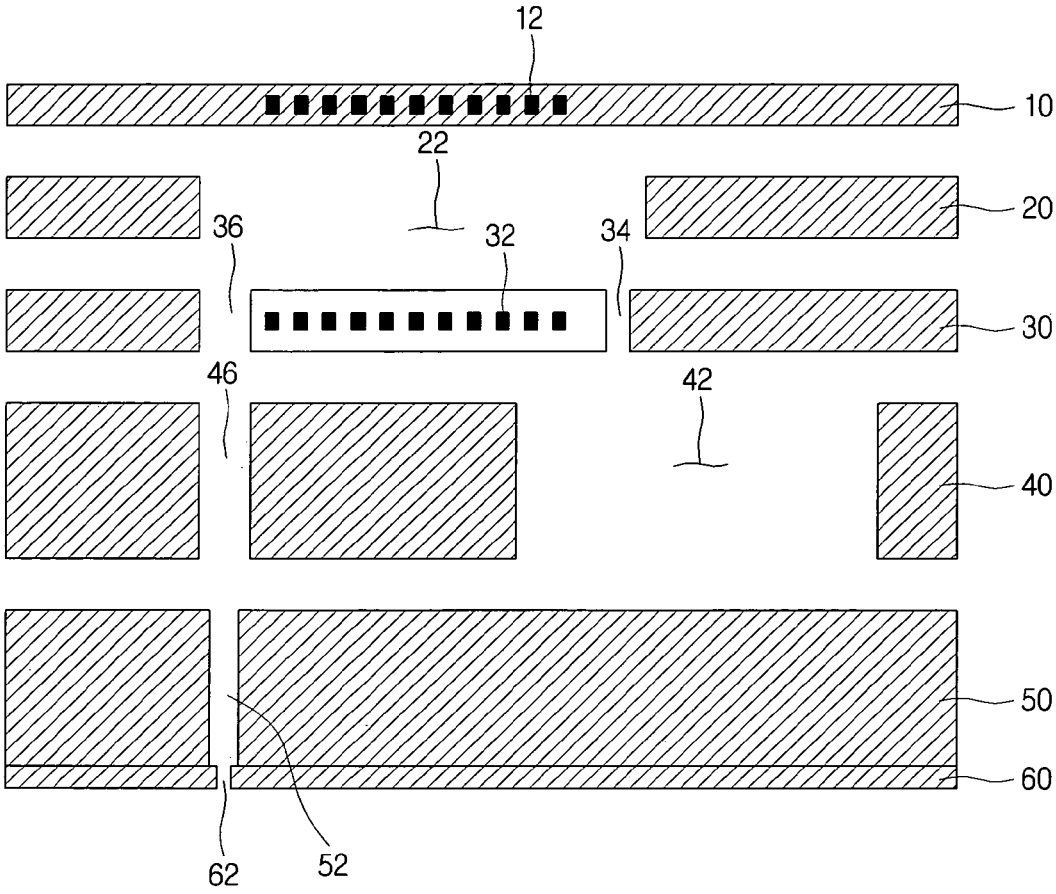

Next, the restrictor 34 is processed, and the first middle plate 30, in which the second coil 32 is placed, is formed, in a step represented by S130. Then, in a step represented by S140, the lower plate part 70, in which the reservoir 42 and the nozzle 62 are processed, is formed. In a step represented by S150, the vibration plate 10, the chamber plate 20, the first middle plate 30 and the lower plate part 70 can be laminated, as illustrated in FIG. 12.

The restrictor 34, the reservoir 42 and the nozzle 62 can be formed by the same method as that of processing the chamber 22 described above. The second coil 32 can be placed in the first middle plate 30 in the same method as that of the first coil 12.

The passages 36, 46 and 52 connecting the chamber 22 to the nozzle 62 can be also formed together with the restrictor 34 and the reservoir 42.

While the present embodiment presents that the reservoir plate 40, the second middle plate 50 and the nozzle plate 60 are separately manufactured and then laminated, it is also evidently possible that one green sheet is processed such that they are integrated together.

Figure 13:
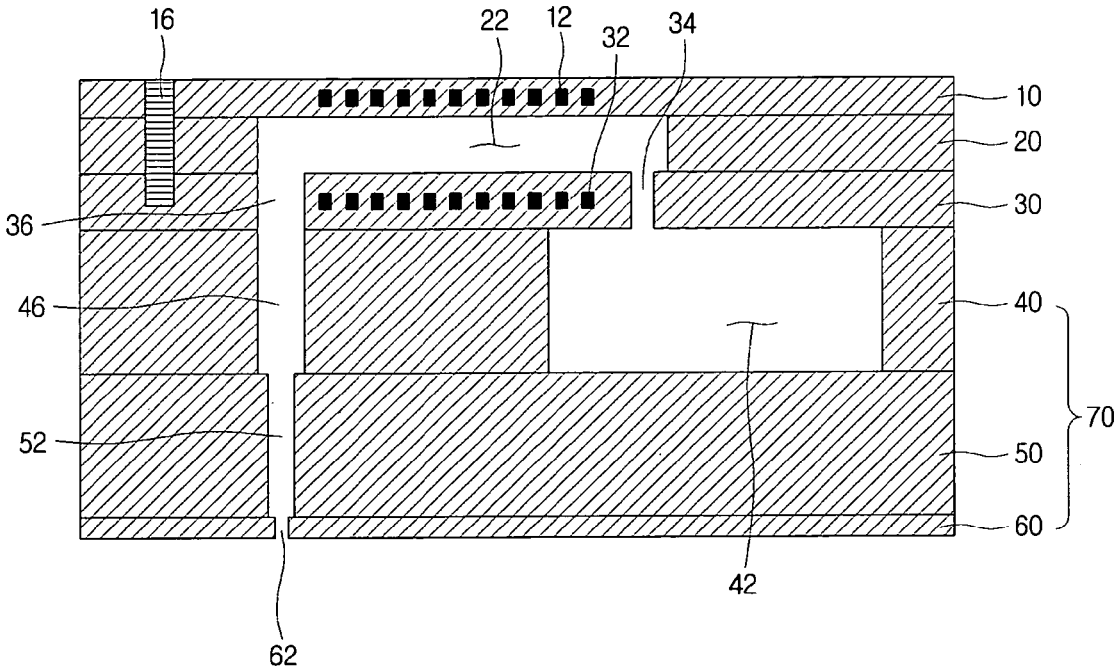

As illustrated in FIG. 13, the via 16 can be processed such that an electric current is supplied to the second coil 32, which is located relatively inside the ink-jet head. That is, as illustrated in FIG. 13, the via 16 can be formed to pass through the vibration plate 10 and the chamber plate 20 and to be electrically connected to the second coil 32, which is formed in the first middle plate 30, so that an electric current is supplied to the second coil 32. The via 16 can be formed by, for example, processing and plating a hole, among many other methods.

As described above, the first coil 12 and the second coil 32 can be formed not to be exposed in the direction of the formation of the chamber 22.

While some embodiments have been described, it shall be understood by those skilled in the art that various changes and modification in forms and details are possible without departing from the spirit and scope of the present invention as defined by the appended claims.

It shall be also understood that a number of other embodiments in addition to the embodiments described above are included in the claims of the present invention.

What is claimed is:

1. An ink-jet head having a reservoir storing ink, a chamber being supplied with the ink from the reservoir, a restrictor connecting the reservoir to the chamber, and a nozzle discharging the ink, the ink-jet head comprising:

a chamber plate, the chamber being formed in the chamber plate;

a vibration plate, being laminated on an upper surface of the chamber plate to cover the chamber, a first coil being placed in the vibration plate;

a first middle plate, the restrictor being formed in the first middle plate, the first middle plate being laminated on a lower surface of the chamber plate, a second coil being placed in the first middle plate;

a lower plate part, the reservoir and the nozzle being formed in the lower plate part, the lower plate part being laminated on a lower surface of the first middle plate; and a via, the via passing through the vibration plate and the chamber plate to be electrically connected to the second coil.

2. The ink-jet head of claim 1, wherein the lower plate part comprises:

a reservoir plate, the reservoir being formed in the reservoir plate, the reservoir plate being laminated on a lower surface of the first middle plate;

a second middle plate being laminated on a lower surface of the reservoir plate; and a nozzle plate, the nozzle being formed in the nozzle plate, the nozzle plate being laminated on a lower surface of the second middle plate.

3. The ink-jet head of claim 1, wherein the vibration plate, the chamber plate, the first middle plate and the lower plate part are made of a low temperature co-fired ceramic (LTCC) material.

4. The ink-jet head of claim 1, wherein the first coil and the second coil are configured not to be exposed in the direction of the chamber.

5. A method of manufacturing an ink-jet head having a reservoir storing ink, a chamber being supplied with the ink from the reservoir, a restrictor connecting the reservoir to the chamber, and a nozzle discharging the ink, the method comprising:

forming a vibration plate, a first coil being placed inside the vibration plate;

forming a chamber plate, the chamber being processed in the chamber plate;

forming a first middle plate, the restrictor being processed in the first middle plate, a second coil being placed inside the first middle plate;

forming a lower plate part, the reservoir and the nozzle being processed in the lower plate part;

laminating the vibration plate, the chamber plate, the first middle plate and the lower plate part; and forming a via passing through the vibration plate and the chamber plate to be electrically connected to the second coil.

6. The method of claim 5, wherein the forming a vibration plate comprises:

patterning the first coil on an upper surface of a first green sheet;

laminating a second green sheet on the upper surface of the first green sheet; and low temperature co-firing the first green sheet and the second green sheet.

7. The method of claim 5, wherein the forming a chamber plate comprises:

processing the chamber on a third green sheet;

filling a support material in the chamber;

sintering the third green sheet; and removing the support material.

8. The method of claim 5, wherein the lower plate part comprises:

a reservoir plate, the reservoir being formed in the reservoir plate, the reservoir plate being laminated on a lower surface of the first middle plate;

a second middle plate being laminated on a lower surface of the reservoir plate; and a nozzle plate, the nozzle being formed in the nozzle plate, the nozzle plate being laminated on a lower surface of the second middle plate.

9. The method of claim 5, wherein the first coil and the second coil are configured not to be exposed in the direction of the chamber.

10. A method of manufacturing an ink-jet head having a reservoir storing ink, a chamber being supplied with the ink from the reservoir, a restrictor connecting the reservoir to the chamber, and a nozzle discharging the ink, the method comprising:

forming a vibration plate, a first coil being placed inside the vibration plate;

forming a chamber plate, the chamber being processed in the chamber plate;

forming a first middle plate, the restrictor being processed in the first middle plate, a second coil being placed inside the first middle plate;

forming a lower plate part, the reservoir and the nozzle being processed in the lower plate part; and laminating the vibration plate, the chamber plate, the first middle plate and the lower plate part, wherein the forming a vibration plate comprises:

patterning the first coil on an upper surface of a first green sheet, laminating a second green sheet on the upper surface of the first green sheet, and low temperature co-firing the first green sheet and the second green sheet.

11. A method of manufacturing an ink-jet head having a reservoir storing ink, a chamber being supplied with the ink from the reservoir, a restrictor connecting the reservoir to the chamber, and a nozzle discharging the ink, the method comprising:

forming a vibration plate, a first coil being placed inside the vibration plate;

forming a chamber plate, the chamber being processed in the chamber plate;

forming a first middle plate, the restrictor being processed in the first middle plate, a second coil being placed inside the first middle plate;

forming a lower plate part, the reservoir and the nozzle being processed in the lower plate part; and laminating the vibration plate, the chamber plate, the first middle plate and the lower plate part, wherein the forming a chamber plate comprises:

processing the chamber on a third green sheet, filling a support material in the chamber, sintering the third green sheet, and removing the support material.

* * * * *